US006718835B2

(12) United States Patent
Wang et al.

(10) Patent No.: US 6,718,835 B2
(45) Date of Patent: Apr. 13, 2004

(54) PRESSURE PLATE EXTRACTOR

(75) Inventors: Xiaodong Wang, Madison, WI (US); Craig Herbert Benson, Verona, WI (US)

(73) Assignee: Wisconsin Alumni Research Foundation, Madison, WI (US)

( * ) Notice: Subject to any disclaimer, the term of this patent is extended or adjusted under 35 U.S.C. 154(b) by 0 days.

(21) Appl. No.: 10/252,285

(22) Filed: Sep. 23, 2002

(65) Prior Publication Data

US 2003/0066211 A1 Apr. 10, 2003

Related U.S. Application Data

(60) Provisional application No. 60/328,282, filed on Oct. 10, 2001.

(51) Int. Cl.[7] ..... G01N 33/00

(52) U.S. Cl. ..... 73/866; 73/38; 73/76; 73/73; 73/866 G

(58) Field of Search ..... 73/38, 76, 866, 73/73

(56) References Cited

U.S. PATENT DOCUMENTS

| | | | | |
|---|---|---|---|---|
| 2,534,718 A | * | 12/1950 | Leas et al. | 73/38 |
| 5,161,407 A | * | 11/1992 | Ankeny et al. | 73/38 |
| 6,055,850 A | * | 5/2000 | Turner et al. | 73/38 |

OTHER PUBLICATIONS

Fredlund, D.G. and Rahardjo, H., 1993, Soil Mechanics For Unsaturated Soils, John Wiley & Sons, Inc., pp. 134–135.

Topp et al.., "Soil Water Desorption Curves," pp. 569–579 Carter, M. R., Ed., Soil Sampling and Methods of Analysis, Can. Soc. of Soil Science, 1993, pp. 569–579.

Methods of Soil Analysis. Part I, Physical and Mineralogical Methods, Second Edition, American Society of Agronomy. Madison, Wisconsin, 1986, pp. 635–662.

Website: http://www.soilmoisture.com/PDF%20Files/exract.pdf, Pressure Extractors, Soilmoisture Equipment Corp. Catalog, pp. 13–20 and pp. 44–46.

Catalog listing of pressure extractors, Soilmoisture Equipment Corp., Santa Barbara, CA (date unknown).

ASTM D 3152–72 Standard Test Method for Capillary–Moisture Relationships for Fine–Textured Soils by Pressure–membrane Apparatus (Reapproved 2000), pp. 1–6.

ASTM D 2325–68 Standard Test Method for Capillary–Moisture Relationships for Coarse–and Medium–Textured Soils by Porous–Plate Apparatus (Reapproved 2000), pp. 1–6.

Website: http://weather.nmsu/edu/Teaching_Material/soil698/Student_Material/pressureplate/Components.htm Components, Aug. 5, 2002 (2 pages).

* cited by examiner

*Primary Examiner*—Hezron Williams
*Assistant Examiner*—Andre K. Jackson
(74) *Attorney, Agent, or Firm*—Craig A. Fieschko, Esq.; DeWitt Ross & Stevens S.C.

(57) ABSTRACT

A pressure plate extractor for testing of soils and other porous solids has a pressure chamber defined by pressure chamber sidewalls resting above a pressure chamber base. A drain plate is situated on the pressure chamber base with its bounding edge surrounded by a seal and situated inwardly from the pressure chamber sidewalls, which rest atop the seal. When the pressure chamber sidewalls are urged towards the pressure chamber base, thereby compressing the seal and preventing air from passing between the pressure chamber sidewalls and pressure chamber base, the seal laterally expands to firmly engage the bounding edge of the drain plate, thereby preventing air from passing between the pressure chamber sidewalls and the drain plate. A substantially leak-free pressure chamber results, with low probability of drain plate failure because the pressure chamber sidewalls do not bear directly upon it.

28 Claims, 2 Drawing Sheets

PRIOR ART

PRESSURE PLATE EXTRACTOR

CROSS-REFERENCE TO RELATED APPLICATIONS

This application claims priority under 35 USC §119(e) to U.S. Provisional Patent Application No. 60/328,282 filed Oct. 10, 2001, the entirety of which is incorporated by reference herein.

STATEMENT REGARDING FEDERALLY SPONSORED RESEARCH

This invention was made with United States government support awarded by the United States Environmental Protection Agency pursuant to Grant No. EPA 68-C5-0036, and by the National Science Foundation pursuant to Grant No. NSF 9800255. The United States has certain rights in this invention.

FIELD OF THE INVENTION

This disclosure concerns an invention relating generally to pressure plate extractors for soil testing, and more specifically to pressure plate extractors intended for leak-free operation.

BACKGROUND OF THE INVENTION

The soil water characteristic curve (SWCC), a parameter which relates suction (matric, total, or both) to water content or saturation, is essential for characterizing the hydraulic and mechanical behavior of unsaturated soils. The method used to measure the SWCC depends on the texture of the soil (coarse vs. fine) and the magnitude of the suctions that must be established. For finer textured soils (silts, clays, and silty or clayey sands), a pressure plate extractor is normally used. A pressure plate extractor generally includes two key components, a pressure chamber (also referred to as a pressure cell) which allows pressurization of its interior, and a porous drain plate which rests within the pressure chamber in communication with soil to be tested, and which receives water or other liquids from the soil during pressurization. The drain plate is usually a ceramic disk, although polymeric membranes are used when very high suctions (>1500 kPa or 150 m of water) are being applied. The structure and operation of pressure plate extractors is better understood with review of common configurations of prior extractors.

FIG. 1 illustrates an exemplary pressure plate extractor 100 (commonly referred to as a "Tempe cell") used for applications where lower suctions (<100 kPa or 10 m of water) are to be applied. The pressure chamber is defined by a lid 102, a base 104, and a cylindrical sidewall 106 (wherein the lid 102 and base 104 are also provided in cylindrical forms between which the sidewall 106 may be fit). A porous drain plate 108 is provided on the base 104 to receive water or other liquid from a soil sample provided atop the drain plate 108 in a retaining ring 110. The base 104 has a recess 112 wherein the liquid may be received. A pressure inlet 114 is provided in the lid 102 for connection to a compressed air cylinder or other pressure source, and a drain outlet 116 is provided in the base 104 to receive water or other liquid expelled from the soil sample into the drain plate 108 during pressurization. O-ring seals 118 are provided between the pressure chamber sidewall 106 and the lid 102 and base 104, and also between the drain plate 108 and base 104. A nut-screw arrangement 120 is provided whereby the lid 102 may be urged against the sidewall 106, which in turn urges against the drain plate 108 and base 104, to close the pressure chamber for pressurization.

When testing at higher pressures is desired, a pressure plate extractor having a more robust pressure chamber is generally used, with an exemplary arrangement being illustrated in FIG. 2. Here, the pressure plate extractor 200 has a pressure chamber defined by a lid 202 and a combined base and cylindrical sidewall 204. A porous drain plate 206 receives water or other liquid from a soil sample provided in a retaining ring 208. A metal screen 210 is situated at the bottom of the drain plate 206, and the screen 210 and the bottom of the drain plate 206 are then enclosed (with the screen 210 held to the bottom of the drain plate 206) by a rubber membrane 212 which is clamped about the edges of the drain plate 206 by a wire wrapping 214. A drain outlet tube 216 then extends from the exterior of the sidewall 204 to the space between the bottom of the drain plate 206 and the rubber membrane 212. A pressure inlet 218 extends through the sidewall 204, and O-ring seals 220 are provided between the lid 202 and sidewall 204 to deter depressurization of the pressure chamber. A nut-screw arrangement 222 is provided to urge the lid 202 against the sidewall 204 to close the pressure chamber for pressurization.

When using the foregoing extractors 100 and 200, the air pressure inside the pressure chamber is elevated via pressure inlets 114 and 218, and atmospheric pressure is generally maintained at the drain outlets 116 and 216 (and thus on the sides of the drain plates 108 and 206 in fluid communication with the drain outlets 116 and 216). Drying SWCC can be measured by first saturating the soil sample, and then applying a series of different pressure differentials (often referred to as "suctions," since water is pulled from the soil sample owing to lower pressure at the drain outlets 116/216) between pressure inlets 114/218 and drain outlet 116/216. Different amounts of water are expelled at different pressure differentials, and the expelled water is measured (gravimetrically or volumetrically) at each suction to define the SWCC.

Although the operating principles of the pressure plate extractors 100 and 200 are conceptually simple, mechanical problems are common, with air leakage being a particular problem. Leakage is highly undesirable because it can invalidate the test results, and since a test to determine SWCC of a sample can take from two weeks to several months to run, an invalid test run can result in significant loss of time and money (and can significantly delay projects wherein the SWCC is needed to proceed). In extractors such as extractor 100, leakage is most prevalent at the outer edge or the bottom of the drain plate 108 from air bypassing the adjacent O-ring seal 118. A common solution is to glue the drain plate 108 in place on the base 104 using epoxy or another adhesive applied around the edge of the drain plate 108, but because the adhesive bond is permanent, the drain plate 108 usually cannot be removed for later cleaning, test preparation, etc. without damage. Also, the rigid connection caused by the epoxy between the drain plate 108 and the base 104 can lead to cracking of the drain plate 108 owing to the pressure differential between the recess 112 and the interior of the pressure chamber, and owing to loading of the drain plate 108 by the sidewall 106 when the sidewall 106 is urged towards the base 104 to seal the pressure chamber. These problems lead to an unfortunate tradeoff: the lid 102 must be tightly clamped to the base 104 to deter leaks, but this is more likely to crack the drain plate 108 (and conversely, air leaks may result if stress on the drain plate 108 is relieved in order to avoid damage). As a result, some degree of leakage always occurs and must be tolerated, though it degrades the quality of the SWCC test results.

The extractor 200 encounters similar problems in that air leakage occurs between the drain plate 206 and the rubber membrane 212 owing to poor sealing by the wire wrapping 214 or other sealing arrangement. Decreases in test accuracy from leakage of the extractor 200 are particularly unfortunate since test data from the extractor 200 are inherently not as precise as for the extractor 100, owing to the relatively small size of the soil sample used in the extractor 200, and also owing to inefficiencies in collecting expelled water in the extractor 200. These collection inefficiencies primarily arise from difficulties in collecting all water from the screen 201 and membrane 212, and air diffusion through the drain plate 206 interfering with measurements.

Additionally, both of the extractors 100 and 200 depicted in FIGS. 1 and 2 have limited sealing capacity between their lids, sidewalls, bases, and drain plates, since their seals 118/220 are set within recesses and can only be compressed to a limited extent. If the seals 118/220 grow less flexible over time (as is common), they may fail to provide the necessary degree of sealing regardless of how far their lids and sidewalls are urged towards their bases.

Owing to the importance of accurate SWCC measurements to civil and environmental engineering projects, and the cost and time involved in obtaining accurate SWCC measurements, there is a substantial need for improvements in pressure plate extractor apparata which overcome the foregoing problems.

SUMMARY OF THE INVENTION

The invention involves a pressure plate extractor which is intended to at least partially solve some of the aforementioned problems. To give the reader a basic understanding of some of the advantageous features of the invention, following is a brief summary of preferred versions of the extractor. As this is merely a summary, it should be understood that more details regarding the preferred versions may be found in the Detailed Description set forth elsewhere in this document. The claims set forth at the end of this document then define the various versions of the invention in which exclusive rights are secured.

A preferred version of a pressure plate extractor constructed in accordance with the invention includes a pressure chamber defined within a pressure chamber base and pressure chamber sidewalls (which may have a pressure chamber lid separately or integrally provided thereon). A drain plate sized to fit on the pressure chamber base is provided within the pressure chamber. A pressure inlet is provided, preferably on the pressure chamber sidewalls and/or pressure chamber lid, to allow pressurization of the pressure chamber. Similarly, a drain outlet for receiving expelled water or other liquid from the drain plate is provided on the pressure chamber base. The drain plate has opposing plate inner and outer faces bounded by a plate intermediate edge, with the plate inner face being situated adjacent the interior of the pressure chamber and the plate outer face being situated outside the pressure chamber interior. The drain plate preferably rests within a depression defined in the pressure chamber base, with the plate intermediate edge being spaced inwardly from the outer walls of the depression.

The pressure chamber sidewalls are preferably sized to extend about the entirety of the drain plate's perimeter, as opposed to being sized to fit atop the drain plate as in the prior pressure plate extractors shown in FIGS. 1 and 2. Thus, if the pressure chamber sidewalls are urged towards the pressure chamber base, they need not bear against the drain plate and stress it, as in the prior pressure plate extractors.

A sealing arrangement is then provided which is believed to offer significant advantages over the prior pressure plate extractor arrangements of FIGS. 1 and 2. A seal, which is preferably formed of an elastomeric strip or ring, is fit about the intermediate edge of the drain plate, and between the drain plate's intermediate edge and the outer walls of the depression formed in the pressure chamber base. The pressure chamber sidewalls are then fit atop the seal between the drain plate and the depression outer walls, and they bear downwardly against the seal to press the seal against the pressure chamber base. This deforms the seal, causing it to expand laterally to tightly engage the drain plate and depression outer walls in the pressure chamber base. As a result, the seal is engaged between all of the pressure chamber sidewalls, the drain plate, and the pressure chamber base. The greater the force used to urge the pressure chamber sidewalls toward the pressure chamber base, the tighter the seal between the sidewalls and base (and between the sidewalls and drain plate), and the tighter the resulting seal between the drain plate and the pressure chamber base. At the same time, the pressure chamber sidewalls do not bear against the drain plate, thereby diminishing the likelihood that the drain plate will fracture. A substantially leak-free pressure chamber with low probability of drain plate failure results.

Advantageously, a pressure plate extractor of this nature is suitable for use at high pressures as well as low pressures, and thus can serve as a replacement for both of the extractors depicted in FIGS. 1 and 2. It can provide substantially higher measurement accuracy than the prior high-pressure extractor arrangements because it does not require use of an inefficient mesh-and-membrane arrangement to collect expelled liquids.

Further advantages, features, and objects of the invention will be apparent from the following detailed description of the invention in conjunction with the associated drawings.

DETAILED DESCRIPTION OF PREFERRED EMBODIMENTS OF THE INVENTION

Figure 3:
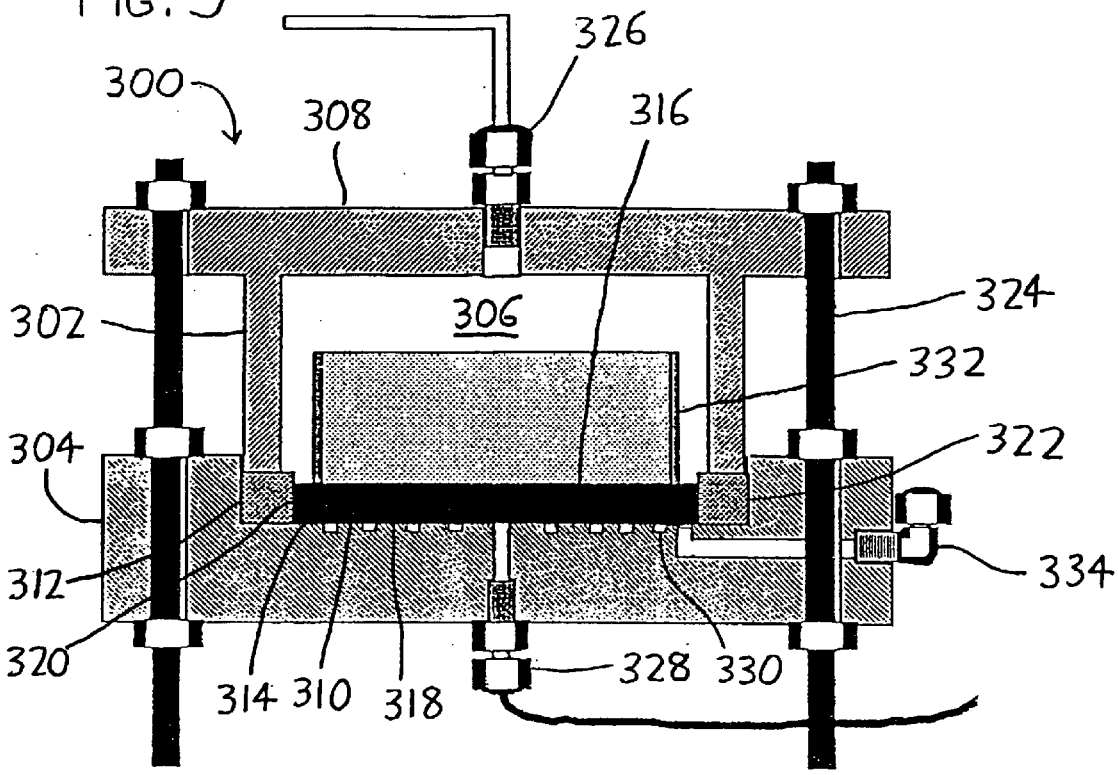
FIG. 3 is a side elevational view of a cross-section of one version of a pressure plate extractor which exemplifies some of the features of the invention, and which may be used for testing at both low and high pressures.

Referring to FIG. 3, and exemplary version of a pressure plate extractor which implements features of the invention is designated generally by the reference numeral 300. The extractor 300 includes a pressure chamber sidewall 302 and a pressure chamber base 304 which combine to define the pressure chamber 306 of the extractor 300. The pressure chamber sidewall 302 preferably has a generally cylindrical configuration, and also preferably includes an integrally joined pressure chamber lid 308. The pressure chamber base 304 includes a depression floor 310 and depression outer walls 312 which define a depression in the pressure chamber base 304, with the depression outer walls 312 being configured to closely receive the pressure chamber sidewall 302 within the pressure chamber base 304. The pressure chamber sidewall 302 and pressure chamber base 304 are preferably formed of brass owing to machinability, cost, and corrosion resistance, though numerous other materials (or combinations thereof) could be used instead.

A drain plate 314 is sized to fit within the pressure chamber base 304 on the depression floor 310. The drain plate 314, which may be made of conventional ceramic, polymeric, or other porous materials in accordance with test requirements, includes an inner surface 316 facing the interior of the pressure chamber 306, an outer surface 318 which rests atop the depression floor 310, and an intermediate edge 320 which is spaced inwardly from the depression outer walls 312. The drain plate 314 is sized such that if the pressure chamber sidewall 302 is placed over it, the drain plate intermediate edge 320 can fit entirely within the pressure chamber sidewall 302 (though preferably such spacing is close), rather than being sized so that the pressure chamber sidewall 302 may only fit atop the inner surface 316 of the drain plate 314.

A seal 322 is fit about the intermediate edge 320 of the drain plate 314 so that the seal 322 rests between the pressure chamber sidewall 302 and the pressure chamber base 304, and also between the drain plate intermediate edge 320 and the depression outer walls 312 formed in the pressure chamber base 304. The seal 322 is preferably formed of elastomeric or other compressible material, with corrosion-resistant elastomers capable of withstanding organic solvents (such as perbunan/Buna-N) being particularly preferred. As is conventional with most elastomers, the seal 322 has a positive Poisson's ratio, i.e., compression of the material along one axis causes expansion along perpendicular axes. When the pressure chamber sidewall 302 is urged towards the pressure chamber base 304, as by use of the nut/screw arrangement shown at 324, the seal 322 will seal the depression chamber sidewall 302 with respect to the pressure chamber base 304. As a result of the positive Poisson's ratio of the seal 322, the compression of the seal 322 between the pressure chamber sidewall 302 and the pressure chamber base 304 causes it to laterally (radially) expand to tightly seal the drain plate intermediate edge 320 with respect to the pressure chamber base 304 at the depression outer walls 312. As a result, the seal 322 is tightly engaged between all of the pressure chamber sidewall 302, the drain plate 314, and the pressure chamber base 304.

Figure 1:
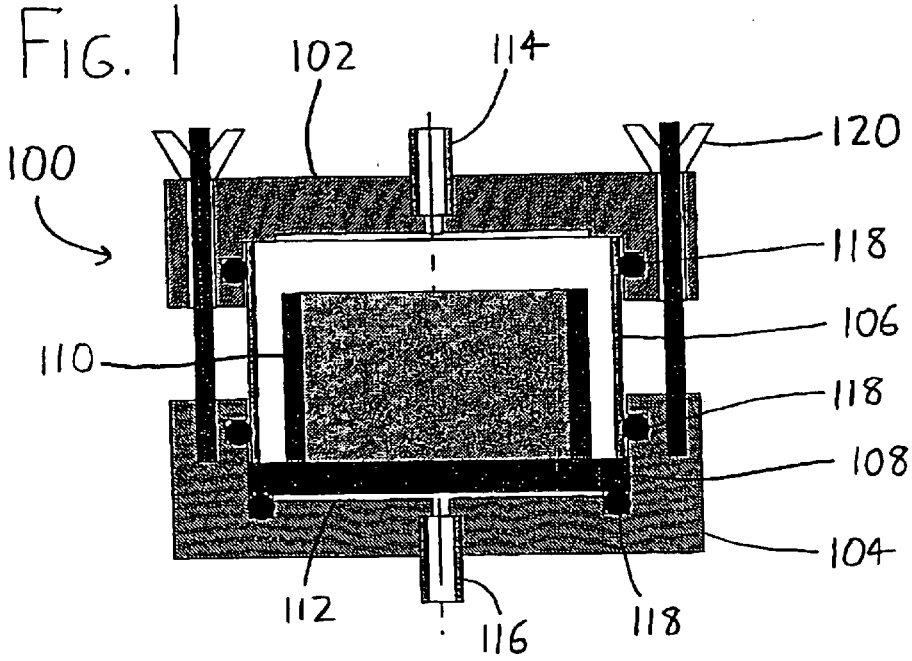
FIG. 1 is a side elevational view of a cross-section of a prior known pressure plate extractor arrangement used for testing at lower pressures.
Figure 2:
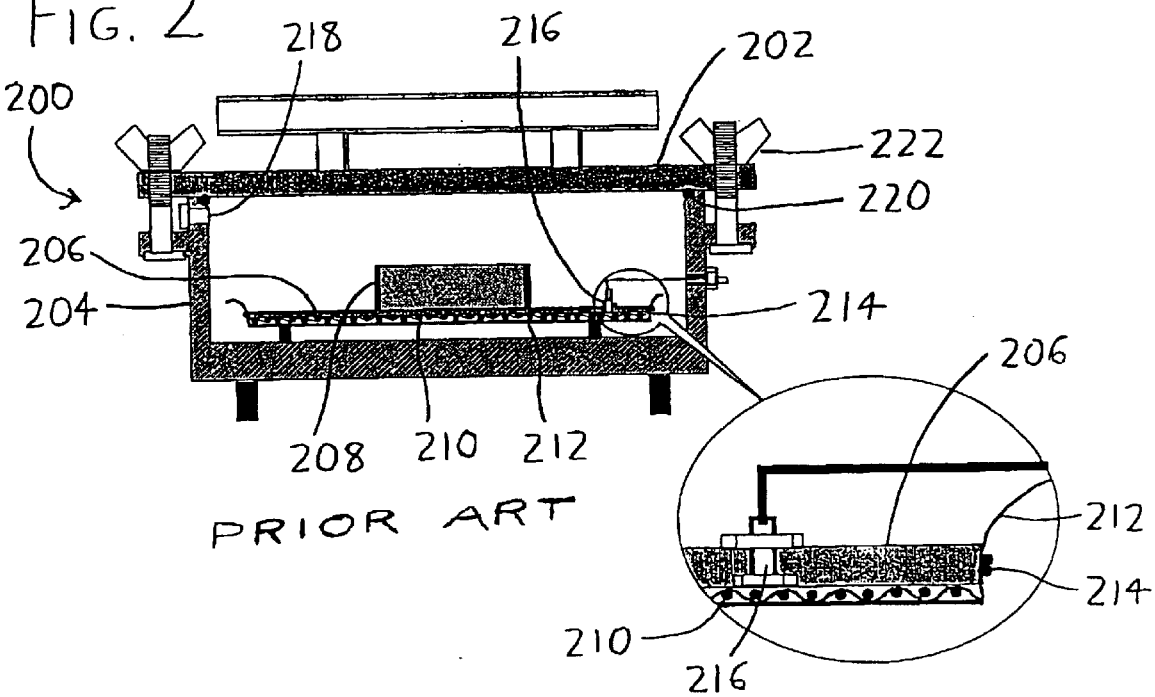
PRIOR ART FIG. 2
FIG. 2 is a side elevational view of a cross-section of a prior known pressure plate extractor arrangement used for testing at a greater range of pressures, including higher pressures.

The use of the foregoing arrangement avoids the noted disadvantage of the prior pressure plate extractor 100 of FIG. 1 that urging the pressure chamber sidewall 106 and the pressure chamber base 104 towards each other, thereby tightening the seal between them, increases the likelihood that the drain plate 108 will be stressed to the point of failure. The pressure chamber sidewall 302 does not bear against the drain plate 314 and is therefore unlikely to fracture it. Additionally, owing to exploitation of the Poisson's ratio effect from compression of the seal 322, urging the pressure chamber sidewall 302 against the seal 322 and pressure chamber base 304 only serves to make the pressure chamber 306 more airtight, even if the seal 322 has begun to lose flexibility owing to aging.

Figure 4:
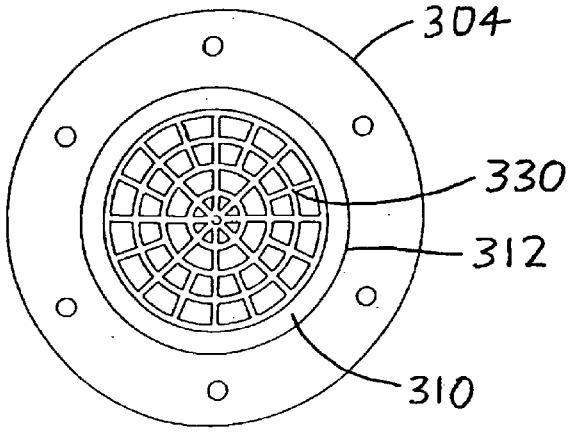
FIG. 4 is a top plan view of an exemplary preferred version of the pressure chamber base 304 of the pressure plate extractor 300 of FIG. 3.

As in the prior pressure plate extractor 100, pressurization may be provided by connecting a compressed air cylinder or other pressure supply to a pressure inlet 326, which is preferably centrally situated on the pressure chamber lid 308 for convenient access. Additionally, a drain outlet 328 is provided in the pressure chamber base 304 adjacent the drain plate outer surface 318 (i.e., on the side of the drain plate 314 opposite the interior of the pressure chamber 306) to receive expelled liquid, and the drain outlet 328 is preferably centrally situated beneath the drain plate 314 to better receive water equally from all sides of the drain plate 314. Rather than situating an enlarged recess beneath the drain plate 314 to receive expelled liquid (as with the recess 112 beneath the drain plate 108 in FIG. 1), it is preferred to define a network of collecting channels 330 in the depression floor 310 of the pressure chamber base 304 so that more of the area of the drain plate outer surface 318 is supported during pressurization. While the collecting channels 330 may be provided in a variety of patterns, a preferred arrangement is to use the "spider web" pattern depicted in the top view of the pressure chamber base 304 depicted in FIG. 4, or to use some other pattern which efficiently collects water expelled from all areas of the drain plate 314 while supporting most of its area. A retaining ring 332 for holding soil to be tested is also provided, and it may take any conventional or desired form.

Figure 5:
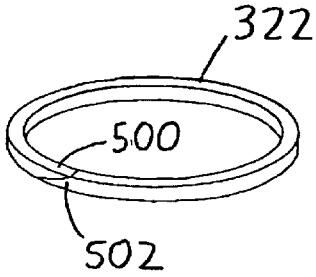
FIG. 5 is a perspective view of an exemplary preferred version of the seal 322 of the pressure plate extractor 300 of FIG. 3.

The seal 322 could take the form of a conventional O-ring having a circular cross-section, but it is preferably provided in the form of a loop which has a square or rectangular cross-section (or is provided by a strip having a square or rectangular cross-section, wherein the strip may be formed into a loop). The square or rectangular cross-section is preferred because it is desirable to have the seal 322 abut the surfaces it engages—the sidewall 302, the depression floor 310, the drain plate intermediate edge 320, and the depression outer walls 312—in plane-to-plane contact, i.e., so that the surfaces of the seal 322 evenly and complementarily contact the surfaces to which they are to engage. An advantage of using a seal 322 formed in this manner is that the seals 322 may be more easily and cheaply replaced than standard O-ring seals; a user may simply take an elongated bar of elastomeric material, cut the bar to such a length that the bar may fit about the drain plate intermediate edge 320 with a slight overlap, and then cut the overlapping sections into complementary mating shapes so that they tightly seal together when compressed. To illustrate, the seal 322 is shown in greater detail in FIG. 5, wherein the seal 322 is formed of a rectangular bar having its ends 500 and 502 chamfered to complementarily overlap. The prior pressure plate extractors 100 and 200 often gave rise to costs from frequent replacement of their seals 118 and 220 (owing to a desire to ensure seal integrity), and this cost is largely avoided in the extractor 300 owing to the efficient sealing arrangement and the ability to use standard bar stock or elongated scrap for a seal 322.

It is understood that the various preferred versions of the invention are shown and described above to illustrate different possible features of the invention and the varying ways in which these features may be combined. Apart from combining the different features of the foregoing versions in varying ways, other modifications are also considered to be within the scope of the invention. Following is an exemplary list of such modifications.

First, it should be understood that unless otherwise required by the claims, components described as being integrally formed may instead be formed separately, and vice versa; for example, the lid 308, rather than being joined to the pressure chamber sidewall 302, might instead be separately provided (as in the pressure plate extractor 100 discussed previously). Additionally, components might be located or arranged differently from the manner previously described. For example, while the pressure inlet 326 is shown as being centrally situated on the pressure chamber lid 308, it might be situated elsewhere on the pressure chamber lid 308 or pressure chamber sidewall 302 if desired.

Second, the extractor 300 may include additional features not discussed above. As an example, a conduit 334 allowing removal of accumulated gas, or allowing insertion of measurement apparata, may be provided (with FIG. 3 illustrating such a conduit in the base 304, though it could be included elsewhere). Additionally, if desired, the pressure chamber lid 308 (or another portion of the pressure chamber 306) can be provided with an overburden piston which extends to the exterior of the pressure chamber 306. The overburden piston may be actuated so that its head is moved to bear on a soil sample within the pressure chamber 306, thereby allowing compression of the soil sample during testing or at other times.

The invention is not intended to be limited to the preferred versions of the invention described above, but rather is intended to be limited only by the claims set out below. Thus, the invention encompasses all different versions that fall literally or equivalently within the scope of these claims.

What is claimed is:

1. A pressure plate extractor comprising:

a. a pressure chamber base having a depression formed therein, the depression having a depression outer wall;

b. a drain plate sized to fit within the depression;

c. a pressure chamber sidewall sized to fit on the pressure chamber base about the drain plate;

d. a seal engaged:

(1) between the pressure chamber sidewall and the pressure chamber base, and (2) between the drain plate and the depression outer wall of the pressure chamber base, such that when the pressure chamber sidewall is urged toward the pressure chamber base, the seal is compressed therebetween, and thereby expands between the depression outer wall and the drain plate.

2. The pressure plate extractor of claim 1 wherein:

a. the drain plate includes:

i. a plate inner face adjacent a pressure chamber interior, ii. an opposing plate outer face outside the pressure chamber interior, and iii. a plate intermediate edge; and b. the plate intermediate edge is surrounded by the pressure chamber base.

3. The pressure plate extractor of claim 1 wherein the seal rests within the depression defined in the pressure chamber base.

4. The pressure plate extractor of claim 1 wherein;

a. the drain plate has opposing plate inner and outer faces bounded by a plate intermediate edge, and b. the seal is engaged between the pressure chamber sidewall and the plate intermediate edge.

5. The pressure plate extractor of claim 1 wherein the drain plate includes:

a. a plate inner face adjacent a pressure chamber interior, wherein the entirety of the plate inner face is surrounded by the pressure chamber sidewall, b. an opposing plate outer face outside the pressure chamber interior, and c. a plate intermediate edge situated between the plate inner and outer faces, wherein the seal surrounds the plate intermediate edge.

6. The pressure plate extractor of claim 1 wherein a. the drain plate has opposing plate inner and outer faces bounded by a plate intermediate edge, the plate inner face being situated adjacent a pressure chamber interior and the plate outer face being situated outside the pressure chamber interior; and b. the pressure chamber sidewall extends about the entirety of the plate inner face.

7. The pressure plate extractor of claim 1 wherein the seal has a first set of opposing planar faces which respectively abut the pressure chamber sidewall and pressure chamber base.

8. The pressure plate extractor of claim 7 wherein the seal also has a second set of opposing planar faces which respectively abut the pressure chamber sidewall and drain plate.

9. The pressure plate extractor of claim 1 wherein the seal is formed of a strip of elastomeric material with its ends situated in abutment.

10. A pressure plate extractor comprising:

a. a pressure chamber base having a depression defined therein, the depression being bounded by depression outer walls;

b. a drain plate fit within the depression;

c. a seal fit between the drain plate and the depression outer walls, the seal being deformable to tightly engage the drain plate and depression outer walls.

11. The pressure plate extractor of claim 10 further comprising a pressure chamber sidewall fit atop the seal between the drain plate and the depression outer walls.

12. The pressure plate extractor of claim 10 wherein:

a. the drain plate includes opposing faces and a plate intermediate edge bounding the opposing faces, and b. the seal surrounds the plate intermediate edge.

13. The pressure plate extractor of claim 10 further comprising a pressure chamber sidewall sized to fit on the pressure chamber base about the drain plate, wherein the pressure chamber sidewall bears against the seal and deforms it to tightly engage the drain plate and depression outer walls.

14. A pressure plate extractor comprising:

a. a pressure chamber base;

b. a drain plate sized to fit on the pressure chamber base, the drain plate including opposing plate inner and outer faces bounded by an intermediate edge;

c. a pressure chamber sidewall sized to fit on the pressure chamber base about the drain plate; and d. a seal including:

(1) a first set of opposing sides, these sides respectively engaging the pressure chamber sidewall and the pressure chamber base;

(2) a second set of opposing sides, these sides respectively engaging the pressure chamber base and the drain plate.

15. The pressure plate extractor of claim 14 wherein:

a. the drain plate rests within a depression formed in the pressure chamber base, the depression having a depression outer wall;

b. the seal is situated between the depression outer wall and the drain plate; and c. when the pressure chamber sidewall is urged toward the pressure chamber base, the seal is compressed therebetween, and thereby expands between the depression outer wall and the drain plate.

16. The pressure plate extractor of claim 14 wherein:

a. the plate inner face is situated adjacent a pressure chamber interior;

b. the plate outer face is situated outside the pressure chamber interior;

b. the plate intermediate edge is surrounded by the pressure chamber base; and c. the seal is also engaged between the pressure chamber sidewall and the pressure chamber base.

17. The pressure plate extractor of claim 14 wherein the seal and drain plate rest within a depression defined in the pressure chamber base.

18. The pressure plate extractor of claim 14 wherein:

a. the plate inner face is adjacent a pressure chamber interior, with the entirety of the plate inner face being surrounded by the pressure chamber sidewall, b. the plate outer face is outside the pressure chamber interior, and c. the seal surrounds the plate intermediate edge.

19. The pressure plate extractor of claim 14 wherein a. the plate inner face is situated adjacent a pressure chamber interior;

b. the plate outer face is situated outside the pressure chamber interior; and b. the pressure chamber sidewall extends about the entirety of the plate inner face.

20. The pressure plate extractor of claim 14 wherein:

a. the first set of opposing sides of the seal, and b. the second set of opposing sides of the seal, are planar.

21. The pressure plate extractor of claim 14 wherein the seal is formed of a strip of elastomeric material with its ends situated in abutment.

22. A pressure plate extractor comprising:

a. a pressure chamber base;

b. a drain plate sized to fit on the pressure chamber base, the drain plate including:

(1) a plate inner face adjacent a pressure chamber interior, (2) an opposing plate outer face outside the pressure chamber interior, and (3) a plate intermediate edge situated between the plate inner and outer faces;

c. a pressure chamber sidewall sized to fit on the pressure chamber base and to surround the entirety of the plate inner face;

d. a seal:

(1) resting between and engaging the pressure chamber sidewall and the pressure chamber base along a first direction, and (2) resting between and engaging the pressure chamber base and the plate intermediate edge along a second direction oriented at least substantially perpendicular to the first direction, such that when the pressure chamber sidewall is urged in the first direction toward the pressure chamber base, the seal is compressed therebetween, and thereby expands in the second direction between the pressure chamber base and the plate intermediate edge.

23. The pressure plate extractor or claim 22 wherein:

a. the drain plate rests within a depression formed in the pressure chamber base, the depression having a depression outer wall;

b. the seal is situated between the depression outer wall and the drain plate.

24. The pressure plate extractor of claim 22 wherein the plate intermediate edge is surrounded by the pressure chamber base.

25. The pressure plate extractor of claim 22 wherein the seal and drain plate rest within a depression defined in the pressure chamber base.

26. The pressure plate extractor of claim 22 wherein the seal has:

a. a first set of opposing planar faces, these faces respectively abutting the pressure chamber sidewall and the pressure chamber base; and b. a second set of opposing planar faces, these faces respectively abutting the plate intermediate edge and the pressure chamber base.

27. The pressure plate extractor of claim 26 wherein the seal also has a second set of opposing planar faces which respectively abut the pressure chamber sidewall and drain plate.

28. The pressure plate extractor of claim 22 wherein the seal is formed of a strip of elastomeric material with its ends situated in abutment.

* * * * *